US011492749B2

(12) United States Patent
Mira Paya et al.

(10) Patent No.: US 11,492,749 B2
(45) Date of Patent: Nov. 8, 2022

(54) METHOD AND APPARATUS FOR TREATING CLOTHS

(71) Applicant: JEANOLOGIA, S. L., Valencia (ES)
(72) Inventors: Ricardo Mira Paya, Paterna (ES); Vicente Albert Revert, Paterna (ES)
(73) Assignee: JEANOLOGIA, S. L., Paterna (ES)

( * ) Notice: Subject to any disclaimer, the term of this patent is extended or adjusted under 35 U.S.C. 154(b) by 53 days.
(21) Appl. No.: 17/264,943
(22) PCT Filed: May 26, 2020
(86) PCT No.: PCT/IB2020/054974
§ 371 (c)(1),
(2) Date: Feb. 1, 2021
(87) PCT Pub. No.: WO2020/240413
PCT Pub. Date: Dec. 3, 2020
(65) Prior Publication Data
US 2021/0317608 A1 Oct. 14, 2021
(30) Foreign Application Priority Data
May 28, 2019 (EP) ..... 19382426
(51) Int. Cl.

| | |
|---|---|
| ***D06F 43/00*** | (2006.01) |
| ***D06F 43/02*** | (2006.01) |
| ***D06F 35/00*** | (2006.01) |
| ***D06F 37/06*** | (2006.01) |
| ***D06F 39/02*** | (2006.01) |
| ***D06F 39/08*** | (2006.01) |
| *D06F 39/14* | (2006.01) |
| *D06F 39/10* | (2006.01) |

(52) U.S. Cl.
CPC ..... *D06F 43/007* (2013.01); *D06F 35/001* (2013.01); *D06F 35/006* (2013.01);
(Continued)
(58) Field of Classification Search
CPC ..... D06F 35/001; D06F 35/006; D06F 37/06; D06F 37/34; D06F 37/38; D06F 39/022;
(Continued)

(56) References Cited

U.S. PATENT DOCUMENTS 3,611,456 A * 10/1971 Hildebrandt ..... D06F 43/007 8/149.1
2002/0083743 A1 7/2002 Uszkureit et al.
(Continued)

FOREIGN PATENT DOCUMENTS

DE 43 30 079 A1 3/1995
EP 1 500 736 A2 1/2005
(Continued)

OTHER PUBLICATIONS

International Search Report and Written Opinion of the International Searching Authority dated Aug. 7, 2020 in corresponding International application No. PCT/IB2020/054974; 9 pages.

*Primary Examiner* — Joseph L. Perrin
(74) *Attorney, Agent, or Firm* — Maier & Maier, PLLC

(57) ABSTRACT

Method and apparatus for treating cloths by spraying with a chemical dispersion including a liquid, the method including: inserting the cloths in a drum that is rotatable about its longitudinal axis, the drum including paddles, where for each of at least two of the paddles the paddle's longitudinal axis forms an angle α of between 5 degrees and 85 degrees with the geometrical orthogonal projection of the paddle's longitudinal axis on a geometrical plane which is normal to the drum's longitudinal axis; with a dispersion supply system providing the chemical dispersion to spraying elements; with rotation elements rotating the drum about its longitudinal axis and reversing the rotational direction at least once, and with spraying elements spraying the drum's interior with the dispersion, the spraying elements being attached a to movable door of a chamber enclosing the drum. The apparatus is adapted for executing the method.

17 Claims, 5 Drawing Sheets

(52) U.S. Cl.
CPC ..... *D06F 37/06* (2013.01); *D06F 39/02* (2013.01); *D06F 39/022* (2013.01); *D06F 39/088* (2013.01); *D06F 43/02* (2013.01); *D06F 39/10* (2013.01); *D06F 39/14* (2013.01)

(58) Field of Classification Search
CPC ..... D06F 39/088; D06F 39/10; D06F 39/14; D06F 43/02; D06F 43/007
See application file for complete search history.

(56) References Cited

U.S. PATENT DOCUMENTS

| | | | | |
|---|---|---|---|---|
| 2002/0133886 | A1* | 9/2002 | Severns | B01J 20/28033 8/142 |
| 2005/0183208 | A1* | 8/2005 | Scheper | D06F 43/02 68/17 R |
| 2006/0179582 | A1* | 8/2006 | Leschaeve | C11D 3/382 68/5 R |
| 2011/0005277 | A1 | 1/2011 | Hasanreisoglu | |
| 2014/0283314 | A1* | 9/2014 | He | D06F 21/14 8/137 |
| 2017/0284007 | A1* | 10/2017 | Hirota | D06F 37/06 |

FOREIGN PATENT DOCUMENTS

| | | | |
|---|---|---|---|
| ES | 2 370 605 | B1 | 10/2012 |
| FR | 2689527 | A3 | 10/1993 |
| GB | 2219603 | A | 12/1989 |

* cited by examiner

METHOD AND APPARATUS FOR TREATING CLOTHS

TECHNICAL FIELD

The present invention relates to the technical field of treating cloths by spraying with a chemical dispersion comprising a liquid, and more specifically to the cases where the treatment takes place within a rotating drum. More specifically, the present invention in a first aspect concerns a method for treating the cloths, and in a second aspect concerns an apparatus adapted to implement the method of the first aspect of the invention. Examples of the cloths concerned by the invention are garments, articles of clothing, towels, bedclothes and other types of pieces of fabrics. The cloths may comprise natural and/or synthetic textiles and/or fabrics and/or other materials such as synthetic and/or animal leather which in combination with textiles are commonly used in garments and clothing.

BACKGROUND

The prior art related to the present invention describes methods and apparatuses for treating cloths by spraying them with a chemical dispersion comprising a liquid while the cloths are in a rotating drum. These methods and systems have some general advantages compared to when the garments are treated by immersing them in a liquid and/or by utilizing conveyor belts and the like for moving the garments while treating the latter in physically long processing lines. The general perception is that treating cloths by spraying, generally requires less liquid and chemicals as compared to the amounts required for wetting and treating the cloths by immersing them in a pool of the dispersion, or by pouring down the dispersion on the cloths. Moreover, rotatable drums generally occupy less space compared to conveyor belts and long processing lines. Likewise, it is simpler to control and ensure the safety of a process that takes place within a rotatable drum; sealing the drum and/or the system containing it for preventing the leak of the chemical dispersion is simpler compared to sealing a physically long and complex processing line. Nevertheless, the use of rotating drums entails the difficulty of having to ensure that within the relatively small volume of the rotating drum the chemical dispersion does not precipitate or otherwise uncontrollably change in form and composition before being delivered to the cloths. Overall, due to their distinct challenges and advantages, the methods and systems for treating cloths with rotating drums and sprays of chemical dispersions comprising liquids are distinct and constitute a different technological field compared to other types of processes and apparatuses for treating cloths.

The closest to the present invention prior-art document is considered to be the applicant's patent ES2370605B1 that concerns a method and a system for softening cloths within a rotatable drum by applying to the cloths an emulsion comprising micro- and nano-bubbles of liquid and air. That document discloses a process takes place within a rotating drum and that the emulsion is applied by spraying. The same document further discloses that the use of the aforementioned micro- and nano-bubbles results to less water consumption and to a more homogeneous and superior treatment of the cloths compared to other methods described in the prior art. It is notable that the aforementioned document does not mention any pending technical problems associated with the method and apparatus described therein, nor describes any directions towards which said method and apparatus need to be further modified for being further improved.

Overall, the aforementioned patent document implies a thesis argument that is recurrent in the prior art. That thesis argument is that spraying a sufficiently tailored chemical dispersion, such as a gas-liquid dispersion, onto cloths within a rotating drum, suffices for wetting and treating homogeneously the cloths. For this reason, the prior art such as the aforementioned document mostly concerns advancements on the preparation and/or composition of the chemical dispersion, and on modifying the volume of the sprayed liquid per weight unit of the cloths. The inventors of the present invention have found that when applying the teachings of the prior art as such, then liquid-induced defects appear on the cloths as a consequence of treating them by spraying onto them a chemical dispersion comprising a liquid. One type of said defects are spots on the cloths' surface. These spots have different appearance, for example have different color and/or texture and/or appearance, compared to the cloth's surface surrounding them. Another type of defect observed in a batch of identical cloths treated together, is that some of the batch's cloths have different appearance compared to the other cloths of the batch as a consequence of treating the batch by spraying. The appearance of said defects impedes the wider application in the textile and cloth industry of systems and methods concerning spraying cloths with chemical dispersions comprising liquids. Moreover, often it appears that the amount of liquid required for processing adequately the cloths by spraying them with said liquid, is higher than the amount originally predicted when considering the quantity and area of the cloths and that the liquid is delivered as a spray. When this happens, it signifies that the liquid has been—at least partially—delivered to the cloths not as a spray but as a liquid that was precipitated before being absorbed by the cloths.

Patent EP 1500736 A2 describes a washing machine that has a tub and a drum within the tub, wherein the drum is mounted for rotation about an axis inclined relative to the horizontal. Patent application document US 2002/0083743 A1 describes a washing machine that has a tub and enclosed therein a laundry drum that is deviates from horizontal by slopping upwards, and has some hollow paddles that have some openings so that during the washing of the clothes said paddles scoop the liquid in the tub for wetting with said liquid the clothes; it is also described that scooped liquid that has entered the hollow paddles can be released on the clothes via said openings of the paddles.

Therefore, a solution is needed to the problems of how to prevent the formation of liquid induced defects on the surface of the cloths, and how to ensure that the liquid is delivered to the cloths in the form of a spray when treating the cloths by spraying them with a chemical dispersion comprising a liquid.

SUMMARY

The present invention provides a solution to the problem of how to prevent the formation of liquid induced defects and inhomogeneities on the surface of the cloths when treating the cloths by spraying them with a chemical dispersion comprising a liquid, and especially when processing a batch comprising several cloths. The present invention also provides a solution to the problem of how to ensure that the sprayed dispersion is delivered onto the surface of the cloths as a spray and not as a liquid precipitated from the original spray.

The present invention concerns a method for treating cloths, and an apparatus adapted to implement said method. The invention essentially relies on the use of a rotatable drum that has certain technical features, and on combining said drum with special ways of operating it and spraying the cloths being inside the drum. Moreover, the present invention concerns optimizing the chemical dispersion for the purpose of maximizing the solution offered by said method and apparatus to the aforementioned problems.

In its first aspect, the present invention is a method for treating cloths by spraying with a chemical dispersion comprising a liquid, the method comprising:

inserting the cloths in the interior of a drum adapted for being rotated about its longitudinal axis, the drum comprising a plurality of paddles which are attached to the interior surface of the drum, wherein for each of at least two of said plurality of paddles the paddle's longitudinal axis forms an angle $\alpha$ of between 5 degrees and 85 degrees with the geometrical orthogonal projection of said paddle's longitudinal axis on a geometrical plane which is normal to the drum's longitudinal axis;

rotating the drum about its longitudinal axis, and reversing the rotational direction about the drum's longitudinal axis at least one time, and during at least part of the duration of rotating spraying the interior of the drum with the chemical dispersion.

Optionally and preferably rotating and reversing the rotational direction is done with rotation means connected to the drum.

Optionally and preferably said spraying is done with (using) spraying means. Optionally and preferably said spraying means are attached to a movable door of a chamber that encloses said rotatable drum, and said movable door when closed faces a mouth and the interior of the drum.

Optionally and preferably the method comprises providing (supplying) said chemical dispersion to said spraying means with (using) a dispersion supply system that is connected to said spraying means. Optionally and preferably the longitudinal axis of the drum is substantially horizontal (e.g. the said longitudinal axis is substantially parallel to a ground on (over) which there is the chamber), so that the cloths can move back and forward across said longitudinal axis, and also so that it is avoided or inhibited the accumulation of liquid in a specific side of the drum.

Spraying is done continuously or discontinuously in time. Spraying discontinuously in time comprises executing spraying sessions the sum of the durations of which is the total spraying time. Preferably the total spraying time is equal to or less than the total duration of rotating. It is possible, although not preferred, stopping and resuming the rotation when executing the method. Spraying is preferably not executed when the rotation is stopped. This means that if rotation is interrupted and spraying is done discontinuously, it is highly preferable that no spraying session is executed during the time that the rotation is stopped. Overall, any time during which no rotational motion of the drum takes place is not accounted when determining the duration of rotating.

Treating the cloths may constitute or be part of one or more of the following processes that are commonly applied on cloths/textiles: softening, bleaching, discoloring, cleaning, dyeing, disinfecting, odorizing, adding chemical substances on and/or removing chemical substances from the surface of the cloths, temporarily exposing the cloths to chemical substances contained in the chemical dispersion, modifying the texture and/or the morphology and/or the structure and/or the mechanical properties and/or the chemistry and/or the composition and/or the visible appearance of the surface and/or of the bulk of the cloths/textiles.

The chemical dispersion of the method comprises at least one liquid. Therefore, the method is not related to the treatment of the cloths with gases or chemical dispersions exclusively consisting of gases since the exclusive use of the latter does not entail the problem to be solved by the present invention. Moreover, as is elaborated further below, the herein presented method compared to the prior art yields a better treatment of the cloths in terms of achieving a good, efficient, fast, homogeneous, qualitative and safe application of the chemical dispersion on the cloth's surface. Said better treatment in turn controls and improves the properties and quality of the cloths in a more economical and ecological way compared to the state of the art.

The rotatable drum is specified as having a plurality of paddles, that means that the drum has at least two paddles, and preferably has three paddles. The paddles attached to the interior surface of the drum are also commonly known as baffles. Optionally, the paddles are disposed in radially symmetrical positions across the circumference of said inner surface, for example, when there are three paddles and the inner surface is cylindrical, it is preferable that the central angle subtended by the arc across the circumference of the inner surface and between two paddles is 120° (degrees). Therefore, optionally the drum with the paddles presents rotational symmetry about the drum's longitudinal and rotational axis as this characteristic facilitates the rotation of the drum and helps to optimize the exposure of the cloths to the sprayed dispersion as is described further below. It is clarified that the front mouth and/or the back mouth of the drum during the process may be close, or partially or completely open, therefore the term "interior surface" mentioned herein, meaning the surface of the interior of the drum on which the paddles are disposed, signifies the surface of the interior of the drum excluding the surface of any caps attached to and covering any of the mouths of the drum, because any of said mouths may be partially or completely open/uncovered. Preferably though one mouth is sealed/closed and the other is open.

The paddles are essentially long bars attached to and lengthwise laying on the inner surface of the drum. The exact shape of each paddle can be any of the shapes commonly described in the prior art. Therefore, in some examples the shape of a paddle's cross section that is normal to the longitudinal axis of the paddle is triangular or tetragonal or orthogonal or circular or ellipsoidal or polygonal or more complex. In some other examples, the shape and dimension of the aforementioned cross section are the same across the length of the paddle, and in some further examples said shape and/or dimensions are not the shame and change across the length of the paddle. Another and preferential option is that the shape of the paddle is twisted across the paddle's longitudinal axis, because this modifies across said axis the force applied by the paddle to the cloths and the air in contact with the paddle, and said modification can offer an additional control of the motion of said cloths and air moved by the paddle when the drum is rotated. This is clarified further below.

An essential element of the invention is that for each of at least two of said plurality of paddles the longitudinal axis forms an angle $\alpha$ of between 5 and 85 degrees with the geometrical orthogonal projection of said paddle's longitudinal axis on a geometrical plane which is normal to the longitudinal axis of the drum. This means that each of said at least two paddles is oriented so that its longitudinal axis is not parallel nor perpendicular to the longitudinal axis of the drum about which the drum rotates. It also means that the longitudinal axis of each of said at least two paddles is not perpendicular nor parallel to the plane which is normal to the longitudinal axis of the drum. It is clarified that the terms "geometrical orthogonal projection", "longitudinal axis" and "geometrical plane" are not used for respectfully naming physical tangible components or parts of the drum and its paddles, but for meaning the respective geometrical/physical concepts commonly used in the art for describing verbally or in writing the shape, morph, position, orientation and properties of physical objects and of components of objects.

The second step of the method comprises spraying to the interior of the drum the chemical dispersion while rotating the drum about its longitudinal axis, wherein the rotational direction about said longitudinal axis is reversed at least once, and preferably is alternatingly reversed several times. In the context of the invention, "alternatingly reversed" signifies that the direction of the rotation is reversed at least two times during the course of the process. Optionally and preferably the direction of the rotation is reversed more than two times during the overall process. Spraying the chemical substance to the interior of the drum serves the purpose of directing the sprayed dispersion towards the cloths contained in the drum. Spraying can be done continuously, meaning in a form of a single long or short in time spray pulse of constant or changing spray flow, or can be done in a discontinuous manner, meaning in the form of multiple successive spray pulses, each spray pulse being a spraying session. The temporal gap in between successive spray pulses is constant or changes in between different sessions. The duration and/or spray flow and/or other spraying parameters for each spray pulse can be different, or all pulses can have the same duration and/or spray flow and/or spraying parameters, when spraying discontinuously in time.

By using a drum of the aforementioned essential characteristics, and by operating the drum in the aforementioned essential way, it is achieved that the chemical dispersion is indeed delivered onto the surface of the cloths in the form of spray and not in the form of liquid precipitated from the spray, and that the cloths are treated by the spray with the surface of each cloth inside the drum being exposed to the spray. As a result of configuring the paddles of the drum to be as described in the method, the force applied to the cloths by the paddles as the drum is rotated has a component which is parallel to the longitudinal axis of the drum. Due to this component, when rotating the drum in one rotational direction about the drum's longitudinal axis, the cloths progressively move towards one end (also known as mouth) of the drum. Consequently, when rotating the drum the cloths move upwards, downwards, and across the length of the drum. Moreover, when the rotational direction of the drum about its longitudinal axis is reversed, the direction of said force component parallel to the longitudinal axis of the drum is also reversed, causing a reverse movement of the cloths across the longitudinal axis of the drum and the cloths progressively move towards the second end (the second mouth) as the drum is rotated. In practice, since the cloths can move across all directions within the rotating drum they also constantly pass over each other while progressively move towards the front or the back of the drum. For this reason, none of the cloths becomes over-treated or under-treated by the spray nor is over-wetted or under-wetted with respect to the rest of the cloths. By preventing over-wetting certain cloths or parts therein in a batch comprising several cloths, it is avoided the precipitation and accumulation of liquid on said over-wetted cloths and parts therein, and thus it is avoided that the rest of cloths or parts be wetted by said precipitated and accumulated liquid. Moreover, as the cloths reciprocate across the longitudinal axis of the rotating drum, they alternatingly move towards and further away from the points or areas through which the chemical dispersion is sprayed. Therefore, the quantity of the spray received by any given cloth may progressively and alternatingly increase and decrease and be controlled in time. This gives the additional benefit of allowing a first quantity of spray falling on the surface of a cloth to be first absorbed by said cloth before an additional quantity falls on the same surface, because otherwise the additional quantity may not be as efficacious as the first quantity. Moreover, it is possible to move away the cloths from a point, such as a spraying nozzle, by which the chemical dispersion is injected. This is important because it allows to avoid the constant presence close to said point/nozzle of a barrier comprising cloths which are constantly flying over and close to said point and are obstructing the injected spray to pass said barrier and disperse further inside and across the volume of the drum. Thus, by avoiding the formation of said barrier and/or by controlling the drum's rotation for moving away this barrier from said point/nozzle, it is ensured that the spray travels deep inside the drum and disperses therein, reaching the surface of all cloths in a homogeneous manner. Likewise, it is possible to control and synchronize the rotational direction of the drum with the spraying of the chemical dispersion. For this reason, it is contemplated the optional case, wherein the duration of rotating comprises rotation sessions, a rotation session being the time between two consecutive events of any of reversing the rotational direction of the drum or beginning or ending rotating, and wherein the set of all rotation sessions comprises a first subset and a second subset of rotation sessions, wherein each rotation session of the second subset succeeds in time a corresponding session of the first subset, and wherein in the second step of the method, any or combinations thereof of the following actions (i)-(iv) occur:

(i) preventing executing spraying when beginning any of the first subset; and/or, (ii) preventing executing spraying when ending any of the second subset of the rotation sessions; and/or, (iii) executing spraying when ending any of the first subset and/or when beginning any of the second subset of the rotation sessions; and/or, (iv) spraying discontinuously in time by executing consecutive spraying sessions (SP1, SP2, . . . ), and beginning any or each of the rotation sessions of the second subset (RS2, RS4, . . . ) during executing or when beginning or when ending executing a corresponding one of the spraying sessions (SP1, SP2, . . . ).

As is obvious, the rotation sessions comprise a first rotation session which starts when rotating begins, and ends when reversing for the first time the rotational direction. There is also a final rotation session which starts when reversing for the last time the rotational direction, and ends when rotating ends. Also, there are all the other rotation sessions, each one defined by two consecutive times of reversing the rotational direction. When during rotating, the rotational motion is interrupted, meaning it is stopped, and then resumed but without the rotational direction being changed, then the corresponding rotation session is considered to be interrupted and resumed respectively. Nevertheless, if a rotation motion is interrupted and then resumed with the rotational direction being changed, then said change is reversing the rotational direction and signifies the beginning of another rotation session.

In any or both of the aforementioned points (i), (iv) the phrases "when beginning" and "when ending" may optionally preferably indicate respectively "within 10 s from starting" and "within 10 s before ending", and more preferably mean respectively "during the first 1% of the duration of" and "during the last 1% of the duration of", and most preferably mean respectively "within the first 40% of the duration of" and "within the last 40% of the duration of", and even more preferably mean respectively "within the first 25% of" the duration of and "within the last 25% of the duration of". Any of the aforementioned times periods or percentages of time periods contribute to have optimum prevention of formation of defects, because they contribute to ensuring a homogeneous application of the sprayed dispersion on the cloths. Points (i)-(iii) are applicable when spraying continuously and when spraying discontinuously. When spraying discontinuously, the phrase "executing spraying" in points (i)-(iii) can be understood as meaning "executing any spraying session".

When spraying discontinuously in time, there is the possibility of executing each of all or of some of the spraying sessions in synchronization with starting or executing a corresponding rotation session of the first subset and/or, preferably, of the second subset of the rotation sessions.

Since, the present method yields a very homogeneous treatment of the cloths within the drum, it also allows for using less chemical dispersion compared to the prior art because the efficiency of the use of said dispersion is optimized with the present method. This renders the present invention faster, safer and more environmentally friendly compared to the state of the art.

As specified, the angle $\alpha$ is of between 5 degrees and 85 degrees as any of these values will result to the existence of the aforementioned force component that causes the movement of the cloths across the longitudinal axis of the drum. Nevertheless, preferably said angle $\alpha$ is of between 50 degrees and 80 degrees, and more preferably between 70 degrees and 80 degrees, because then the average speed of the forward or backward movement of the cloths is maximized for a given rotational speed of the drum. Consequently, the spray is applied across all cloths in an even more homogeneous manner.

Another complementary way of controlling the force applied by the paddle to the cloths, and thus controlling the motion of the cloths within the rotating drum, is to control the exact orientation of the external surfaces of the paddle in contact with the cloths. For this reason in an optional variation of the method, an external surface of at least one paddle has a linear segment which has two extreme points that belong to a geometrical plane which is normal to the paddles longitudinal axis, and are connectable by a straight line which in between said extreme points does not pass though the external surface of the paddle, and wherein said line forms and angle b of between 5 degrees and 85 degrees with the line's orthogonal projection on the geometrical plane that is tangent to the interior surface of the drum at the center of the interface between the drum and the paddle belonging to said geometrical plane which is normal to the paddle's longitudinal axis. The angle b may optionally be of between 5 degrees and 50 degrees, or be of between 15 degrees and 65 degrees.

The shape of the outer and/or inner surface of the drum used for applying the method can be cylindrical, or ellipsoidal or polygonal or more complex, as long as such shape allows for and facilitates rotating the drum when required by the process. Preferably, the drum has a substantially cylindrical shape, because that allows for controlling well the rotational speed of the drum when rotating it, and also because then the linear speed of the drum's interior surface on which the paddles are disposed is substantially uniform, and this contributes to the good control of and uniformity offered by the treatment method. For the same reason, preferably the ensemble comprising said surface and the paddles attached to it presents a rotational symmetry about the drum's rotational and longitudinal axis, and this applies when said surface is cylindrical, or polygonal, or ellipsoidal or has any other suitable shape.

Optionally in the method described herein the chemical dispersion comprises a gas. In that optional case the method works exceptionally well because the gas component facilitates the optimum delivery of the dispersion to the cloths. Moreover, depending on the technical purpose of the treatment method, the gas component may be chosen due to its reactivity with the cloths and the effects causing on them, or due to its reactivity with other components of the dispersion. For example, the gas can be ozone when bleaching or discoloring or disinfecting the cloths by the application of the method. Therefore, it is disclosed that when the chemical dispersion comprises a gas, then optionally the gas includes any of air, nitrogen, oxygen, ozone, argon, carbon dioxide, hydrogen, because any of these gases can be used in the treatment of textiles. Nevertheless, it must be mentioned that the aforementioned specific gases are non-limiting examples. It must also be mentioned that the optional gas component of the chemical dispersion can be the same or different from the carrier medium/gas of the spray that comprises the chemical dispersion. Said gas medium/carrier gas can comprise any of the gases commonly used in the industry for spraying chemical dispersions onto cloths, non-limiting examples of such gases are air, nitrogen, oxygen, ozone, argon, carbon dioxide, hydrogen.

When the chemical dispersion comprises a gas, then optionally the dispersing medium of the chemical dispersion is a liquid and the dispersed substance of the dispersion comprises a gas. This optional variation of the method may be chosen when the liquid and gas components of the dispersion affect the cloths in a synergistic manner, and/or when one component facilitates the good delivery of the other component onto the cloths and its reaction with said cloths, or when the two components react with each other prior and/or during and/or after the dispersion contacts the cloths. When the treatment requires the use of a chemical dispersion comprising both a gas and a liquid, the present method offers the additional advantage of allowing for a good control over the stoichiometry of the dispersion contacting the cloths because the method contributes to delivering well and fast the dispersion onto the cloths in the form of spray. This is important considering that the concentration and/or efficacy and/or temporal evolution of the gas component of the dispersion, especially when said gas component is a dispersed substance within a liquid dispersion medium, depends on whether the dispersion is in the form of spray or not. It is noted that the functionality of the sprayed dispersion and the good delivery of the latter on the cloths can also be affected by the size of the spray's particulates that comprise the liquid of the dispersion. For this reason, in an optional variation of the method and when the dispersing medium of the chemical dispersion is a liquid and the dispersed substance of the dispersion comprises a gas, the dispersed substance forms bubbles the diameter of which is of between 10 nanometers and 900 micrometers. Bubbles of said size range are particularly stable within the rotating drum until delivered onto the cloths, and are particularly effective in modifying the properties of the cloths when applied on the latter.

Similarly, it is disclosed the optional possibility that in the herein described method, the chemical dispersion is an aerosol. In this case the aerosol comprises droplets that comprise the liquid of the dispersion, and optionally also comprise solid particles which add to the effectiveness of the treatment method by causing changes of the properties of the cloths, and/or by interacting with the other components of the dispersion, and/or by affecting how said other components cause changes of the properties of the cloths. Optionally the size of the droplets and/or of the solid particles of the chemical dispersion is of between 10 nanometers and 900 micrometers.

The aforementioned solid particles can be within said droplets or can be outside of them or can be on their surface. The liquid droplets comprise at least one liquid solvent, and can optionally comprise one or more additional chemical substances, wherein each of them is dissolved completely or partially within said at least one solvent, or forms aggregates within said solvent or forms an emulsion with said solvent. Since the purpose of the chemical dispersion is the modification of the cloths, in the method optionally and preferably the chemical dispersion includes any of a chemical product commonly used for cloth finishing; optionally the chemical dispersion comprises any of the following or combinations thereof: a fabric softener, a conditioner, a detergent, an enzyme, a dye, an acid, a base, a silicone, a fatty acid, a reticulation resin, a polymerizing resin, a bleach, an odorizing additive similar to a perfume, an antimicrobial agent, a bactericide, a fluorocarbon, an antivectorial product, a pigment, a nanomaterial, a hydrophilic substance, a hydrophobic substance.

As mentioned further above, either of the mouths of the drum may be open or closed. Nevertheless, it is preferable that the chemical dispersion is being sprayed through an at least one area which is substantially close to a mouth of the drum, and a good way of implementing this is that the back mouth of the drum is closed by a cap attached to it preventing the cloths from exiting the drum from said back mouth, while the front mouth of the drum is open and substantially close to it there are spraying means with which the chemical dispersion is sprayed towards the interior of the drum. The spraying means can for example be one spray nozzle or an ensemble of spraying nozzles located very close and preferably in front of the mouth and facing the opening towards the interior of the drum, or similarly located on the ring-shaped perimeter of the mouth of the drum. Each nozzle is characterized by the area located right in front of it towards the interior of the drum, and through this area the chemical dispersion is passing as it exits the spraying means and starts travelling towards the interior of the drum. The chemical dispersion as it exits the spraying means and said area travelling towards and across the drum's interior, is being progressively diffused and spread out by its interaction with the atmosphere inside the drum.

It is also contemplated the case of inserting the spraying means inside the interior of the drum through the mouth after the cloths have also been inserted, wherein the spraying means are on a support structure that is suspended inside the drum, and then after the end of the treatment process, extracting from the interior of the drum the means and the support holding them. It is also contemplated the case wherein the drum has openings, such as holes drilled on its interior surface, and the chemical dispersion is being sprayed through said openings.

Compared to the prior art, the method of the present invention offers controlling the position of the cloths, and moving the latter at a desired distance from the spraying means, before injecting with said spraying means the chemical dispersion. For example, when the chemical dispersion is being sprayed through an at least one area which is substantially close to the front mouth of the drum, it is possible first moving the cloths towards the back mouth of the drum before spraying the chemical dispersion, while subsequently reversing the rotational direction of the drum thus moving the cloths towards the front mouth of the drum and the sprayed chemical substance. Therefore, in an optional variation of the method the rotational direction about the drum's longitudinal axis is reversed after spraying the chemical substance. Similarly, it is contemplated that the second step of the method in its most fundamental version, that step being:

rotating the drum about its longitudinal axis, and reversing the rotational direction about the drum's longitudinal axis at least one time, and during at least part of the duration of rotating spraying the interior of the drum with the chemical dispersion, is optionally implemented in the following mode:

rotating the drum about one rotational directional about the drum's longitudinal axis;

spraying to the interior of the drum the chemical dispersion;

reversing the rotational direction at which the drum is being rotated about the drum's longitudinal axis.

Another optional mode for implementing the second step of the method in its most fundamental version, is the following:

rotating the drum about one rotational directional about the drum's longitudinal axis;

reversing the rotational direction at which the drum is being rotated about the drum's longitudinal axis;

spraying to the interior of the drum the chemical dispersion.

Optionally, to the aforementioned optional modes any or both of the following steps can be added, in any order between them:

reversing the rotational direction at which the drum is being rotated about the drum's longitudinal axis;

spraying to the interior of the drum the chemical dispersion.

Optionally, the aforementioned optional modes of executing the second step of the method can be combined between them and can be repeated several times during the execution of the treatment method. Finally, it must be further clarified, that it is possible constantly spraying the chemical dispersion while rotating the drum towards any of the two possible rotational directions about its longitudinal axis.

For spraying, the chemical dispersion is pressurized before being sprayed and travels sufficiently far inside the drum and treats homogeneously the cloths, and it has been found by the inventors that the treatment is optimized when the chemical dispersion is pressurized at a minimum pressure of 2 bars. Preferably the pressure of the chemical dispersion is between 2 bars and 60 bars, and more preferably between 2 bars and 30 bars, and most preferably between 6 bars and 30 bars.

Compared to the prior art, the present invention allows for a better and more homogeneous treatment of the cloths with the sprayed chemical dispersion, and consequently allows for increasing the flow of the chemical dispersion to very high values, and for example up to 240 L/min (liters per minute) or up to 300 L/min. Therefore, in the present method the chemical dispersion is optionally sprayed at a flow of between 0.5 L/min and 300 L/min, and preferably of between 0.5 L/min and 240 L/min, and more preferably of between 31 L/min and 240 L/min.

Spraying the cloths with the chemical dispersion comprising a liquid results to wetting the cloths, and an important parameter that defines the effectiveness of the method is the final wet pickup value (w.p.u.) of the cloths, which is defined as follows:

w.p.u.=100*(weight of the liquid absorbed by the cloths)/(weight of the cloths when the latter are dry)(%), wherein both the weights of the absorbed liquid and of the cloths are measured in the same weight units. For example, a wet pick up of 70% means that 70 kg of sprayed liquid were absorbed by 100 kg of cloths contained in the drum. It is herein disclosed that optionally the method comprises stopping the second step of the method when a wet pick up value of between 5% and 150%, and preferably of between 40% and 120%, is achieved. Optionally, the achieved wet pick up value is of between 5% and 50%.

The duration of the second step of the method is also another important parameter that is optionally controlled for further optimizing the method of the invention. Specifically, the second step of the method preferably lasts between 1 minutes and 120 minutes, more preferably between 1 minute and 60 minutes, and most preferably between 2 minutes and 30 minutes. Obviously, the aforementioned time ranges are linked to the ability offered by the method for wetting the cloths for prolonged periods of time without over-treating some of the cloths, and also to the ability offered for treating the cloths for short periods of time while ensuring that the achieved treatment is homogeneous across all cloths.

Since one of the advantages offered by the present invention is optimizing the delivery of the sprayed chemical dispersion to the cloths within the drum, the method also results to having within the drum an atmosphere with a well dispersed chemical dispersion in the form of spray which can be controlled as to not precipitate or absorbed by the cloths within the drum as fast as compared to the prior art. When the chemical dispersion comprises toxic substances, such as a bleaching agent, it is important for safety and technical reasons to be able to remove said spray of the dispersion from the drum during and/or after the application of the method and before the cloths are removed from the drum. For this reason, optionally the method further comprises removing from the interior of the drum the atmosphere containing the sprayed chemical dispersion and filtering out the chemical dispersion from the removed atmosphere. Filtering out can be done by using a filtering unit configured for retaining the toxic components of said gaseous atmosphere, and non-limiting examples of said filters are gas permeable solid materials, or liquids through which the atmosphere is passed. The atmosphere of the drum can be pushed out of the interior of the drum and into the filter by flushing the drum with a non-toxic gas, and/or by pumping out said gas atmosphere using a pump.

The second aspect of the invention concerns an apparatus, configured to implement the method of the first aspect of the invention. Therefore, herein it is disclosed an apparatus arranged for treating cloths with a chemical dispersion comprising a liquid, comprising:

a rotatable drum adapted for being rotated about its longitudinal axis, that comprises a plurality of paddles which are attached to the interior surface of the drum, wherein for each of at least two of said plurality of paddles the paddle's longitudinal axis forms an angle a of between 5 degrees and 85 degrees with the geometrical orthogonal projection of said paddle's longitudinal axis on a geometrical plane which is normal to the drum's longitudinal axis;

rotation means connected to the drum and adapted for rotating it in each direction about its longitudinal axis;

spraying means adapted for spraying to the interior of the drum the chemical dispersion;

a dispersion supply system connected to the spraying means and adapted for providing the latter with the chemical dispersion.

Said spraying means are adapted for spraying continuously or discontinuously in time.

The dispersion supply system contains the chemical dispersion or the at least one liquid of it that is supplied to the spray means, or can optionally comprise chemical dispersion preparation means which are configured to mix the components of the chemical dispersion and/or to prepare the chemical dispersion to a final form to be sprayed. For example, the chemical dispersion preparation means may comprise a tank in which the at least one liquid of the chemical dispersion is atomized and mixed with the gas which is also used as the carrier gas for spraying the dispersion, or/and be mixed with other liquids or gases or solid substances which optionally are partially or completely dissolved in said at least one liquid. In another example, when the chemical dispersion comprises bubbles comprising a liquid and a gas, the chemical dispersion preparation means may comprise components configured to generate and/or control the characteristics of such bubbles, by ultrasonication or any other suitable technique. Optionally, the chemical dispersion or the at least one liquid of it, is supplied by the dispersion supply system to the spraying means by which it is mixed with the carrier gas of the spray as is sprayed and carried by said carrier gas. The dispersion supply system comprises at least one tube connected to the spraying means, and through said at least one tube the chemical dispersion or the at least one liquid of it is supplied to the spraying means.

Optionally, the chemical dispersion comprises at least two tubes wherein at least one tube supplies to the spraying means the carrier gas of the spray of the chemical dispersion.

Optionally, the chemical dispersion preparation means may comprise components configured to store and/or supply and/or generate the components of the chemical dispersion. For example, when the chemical dispersion comprises water then the chemical dispersion preparation means may optionally comprise a water supply component connected to a water supply network. In another example, when the chemical dispersion comprises ozone, the chemical dispersion preparation means may comprise an ozone generator configured to convert oxygen from the atmospheric air to ozone.

The rotation means of the apparatus comprise at least one motor which is connected to a power supply unit, such as an electrical power supply unit, and is also connected to and rotates the drum about the longitudinal axis of the latter. The motor can be in direct contact with the drum, for example by being in contact with a shaft protruding from the exterior surface of the drum, or can be connected to the drum via intermediate components such as a set of gears or a stretch belt which are in contact with both the drum and the motor and serve as motion translation means for translating the rotation of the motor into rotation of the drum.

In accordance to certain of the aforementioned optional features of the method of the invention, the apparatus may optionally comprise a filter unit connected to the interior of the drum via a gas removal system, wherein the filter unit is configured to absorb the toxic components of the chemical dispersion contained in the drum in the form of spray. The gas removal system comprises at least one tube connected to both the drum—or to a chamber containing the drum—and to the filter unit, and optionally comprises a gas pump, and/or a gas flushing system configured for flushing the interior of the drum with a non-toxic gas, for forcing the chemical dispersion spray out of the drum and into the filter unit.

Preferably, the apparatus further comprises the aforementioned chamber that encloses said rotatable drum and comprises a movable door which when closed faces a mouth and the interior of the drum, and wherein the spraying means are attached to said movable door. Said chamber is configured to support the drum and the mechanism by which the drum is rotated. The chamber is preferably configured to prevent the leak of toxic substances from the interior of the drum to the atmosphere outside the chamber, when said movable door is closed. An optional feature of the apparatus is that the spraying means are positioned substantially close to a mouth of the drum. One possible way of achieving this is having the spraying means attached to the movable door as mentioned further above. The chamber optionally encloses any of the other essential and optional elements of the apparatus such as the filtering unit.

In the apparatus, optionally an external surface of at least one paddle has a linear segment which has two extreme points that belong to a geometrical plane which is normal to the paddle's longitudinal axis, and are connectable by a straight line which in between said extreme points does not pass though the external surface of the paddle, and wherein said line forms and angle b of between 5 degrees and 85 degrees with the line's orthogonal projection on the geometrical plane that is tangent to the interior surface of the drum at the center of the interface between the drum and the paddle belonging to said geometrical plane which is normal to the paddle's longitudinal axis. The angle b may optionally be of between 5 degrees and 50 degrees, or be of between 15 degrees and 65 degrees.

It is also important to mention that the apparatus optionally further comprises a computer configured to receive instructions from the user on the exact parameters of the treatment method to be implemented by the apparatus, and also configured to control the operation of the various components of the apparatus. For example, the computer may be connected to and adapted for controlling the rotation means and the spraying means, and any other of the apparatus' components, and is adapted for implementing the second step of the method, such as for controlling the duration of rotating, and/or controlling the time(s) at which the rotational direction is reversed, and/or controlling any optional pauses during rotation, and/or controlling the time sequence by which the rotation sessions and/or spraying sessions are executed, controlling the duration of each different rotation session and/or spraying session, and/or controlling the flow and other properties of spraying for each of the spraying sessions, and/or synchronizing the executions of spraying sessions and corresponding rotation sessions, according to instruction of the user and/or according to pre-programmed and stored in the computer programs. It is also disclosed that the apparatus is connectable to an external power supply for receiving the power which is necessary for the operation of the apparatus.

BRIEF DESCRIPTION OF THE DRAWINGS

The previous and other advantages and features will be more fully understood from the following detailed description of embodiments, with reference to the attached figures, which must be considered in an illustrative and non-limiting manner, in which.

DETAILED DESCRIPTION OF THE EMBODIMENTS

Figure 1A:
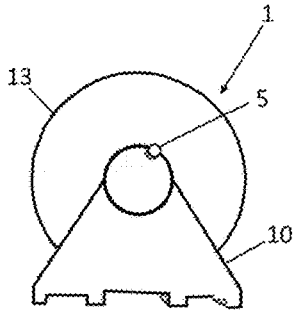
FIG. 1A shows a back view of an embodiment of the drum related to the first and second aspects of the invention.
Figure 1B:
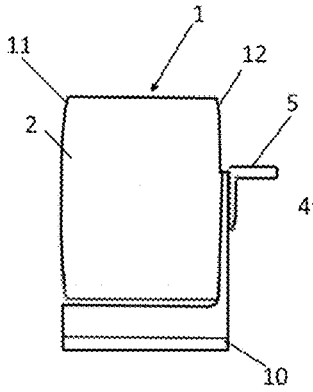
FIG. 1B shows a side view of the embodiment of the drum shown in FIG. 1A.
Figure 1C:
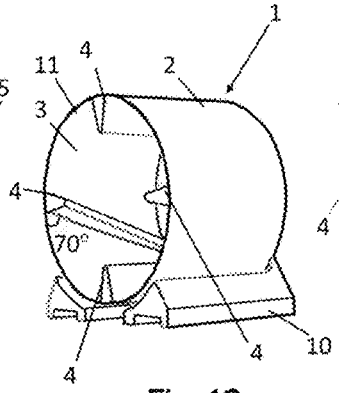
FIG. 1C shows a perspective of the embodiment of the drum shown in FIG. 1A and FIG. 1C.
Figure 1D:
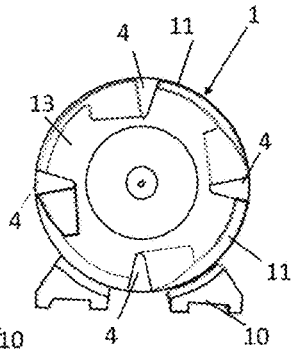
FIG. 1D shows a front view of the embodiment of the drum shown in FIG. 1A, FIG. 1B and FIG. 1C.

A preferred embodiment of the rotatable drum 1 described in the first and second aspect of the invention is shown in FIG. 1A-1D with each of these figures showing a different view/perspective of the drum 1. FIG. 1A is a back view of said drum 1 and shows that the back mouth 12 (indicated in FIG. 1B) of the drum 1 is closed by a cap 13. As indicated, the drum 1 of this specific embodiment is lengthwise oriented parallel to the level of the ground and is supported by a supporting base 10, which also holds the rotation means 5 which are necessary for rotating the drum and in this case can be driven manually. In FIG. 1B which is a side view, there are also indicated the drum's external surface 2, and the front mouth 11 and the back mouth 12 of the drum 1. In FIG. 1C which is a perspective of the drum 1, there are shown the drum's interior surface 3 on which there are disposed four paddles 4, wherein the longitudinal axis (not indicated) of one paddle forms an angle of 70 degrees with the drum's front mouth 11 which obviously is normal to the drum's longitudinal axis (not indicated), therefore said angle of 70° is the angle a. It is noted that since the shown drum 1 is cylindrical having circular mouths 11, 12 and a disc-shaped cap 13 covering the back mouth 12, the drum's longitudinal axis about which the drum 1 rotates is normal to said cylindrical cap 13. It is also noted that the cross section of each of the paddles 4 shown has a triangular shape and does not change along the length of the paddle. The exterior surface 2 of the drum 1 is also indicated in FIG. 1C. FIG. 1D is the front view of the drum and it shows that the four paddles 4 of the drum 1 are positioned in symmetric positions around the circumference of the inner surface 3 of the drum 1 so that the drum 1 has a rotational symmetry. In this case, the central angle (not shown) subtended by the arc across the circumference of the inner surface 3 and between every two neighboring paddles is 90° (degrees).

Figure 2:
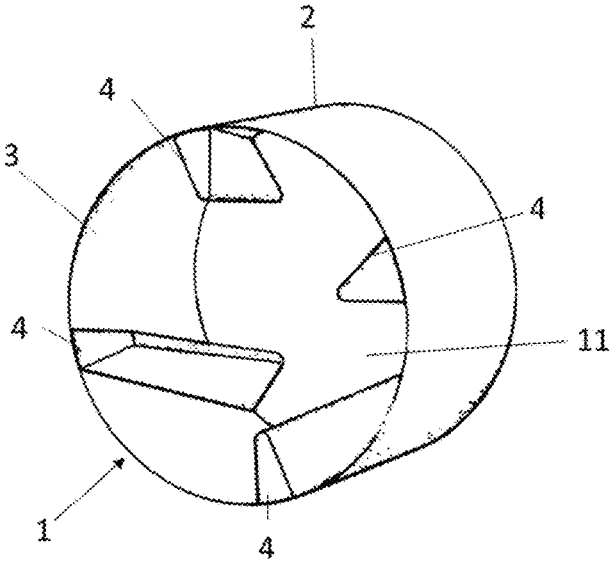
FIG. 2 shows a perspective of a second embodiment of the drum related to the first and second aspects of the invention.

FIG. 2 shows a similar, yet different embodiment of the drum 1, wherein the shape of each paddle 4 is twisted across the paddle's longitudinal axis (not shown).

Figure 3:
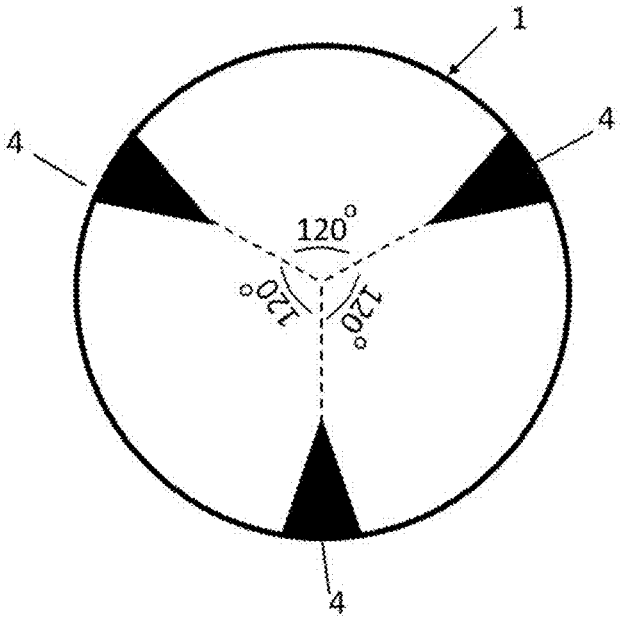
FIG. 3 shows a cross section of the drum related to the first and second aspects of the invention, wherein the cross section is normal to the drum's longitudinal axis.

FIG. 3 shows an embodiment of the drum 1 having three paddles 4 attached to its interior surface, wherein the shape of each paddle 4 as viewed on the plane of the figure is triangular, and wherein as indicated the drum has a rotational symmetry because the central angle subtended by the arc across the circumference of the inner surface 3 and between every two paddles is 120° (degrees).

Figure 4:
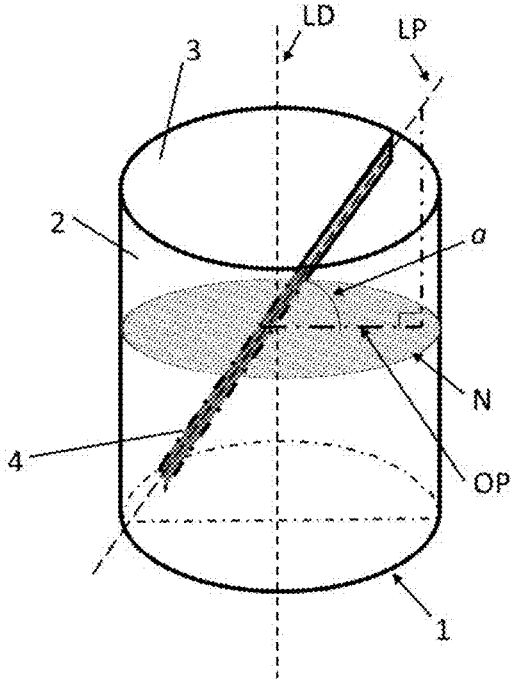
FIG. 4 shows a perspective of another embodiment of the drum of the first and second aspects of the invention, with only one of the drum's paddles indicated therein for the purpose of illustrating how the angle a is defined.

FIG. 4 shows how the angle a related to the orientation of the paddle's longitudinal axis LP is defined. It is noted that for clarity of presentation, only one of the drum's paddles 4 is shown in FIG. 4. The shown paddle 4 is attached to the interior surface 3 of the drum 1, and the part of the paddle which is behind the shown drum's external surface 2 is drawn using dash-dotted lines, wherein the rest of the paddle 4 is drawn using solid lines. The drum's longitudinal axis LD and a plane N which is normal to said drum's longitudinal axis LD are also shown. The orthogonal projection OP of the paddle's longitudinal axis LP on said plane N is indicated by the respective dash-dotted line. The angle a is the angle formed between the paddle's longitudinal axis LP and said orthogonal projection OP.

Figure 5:
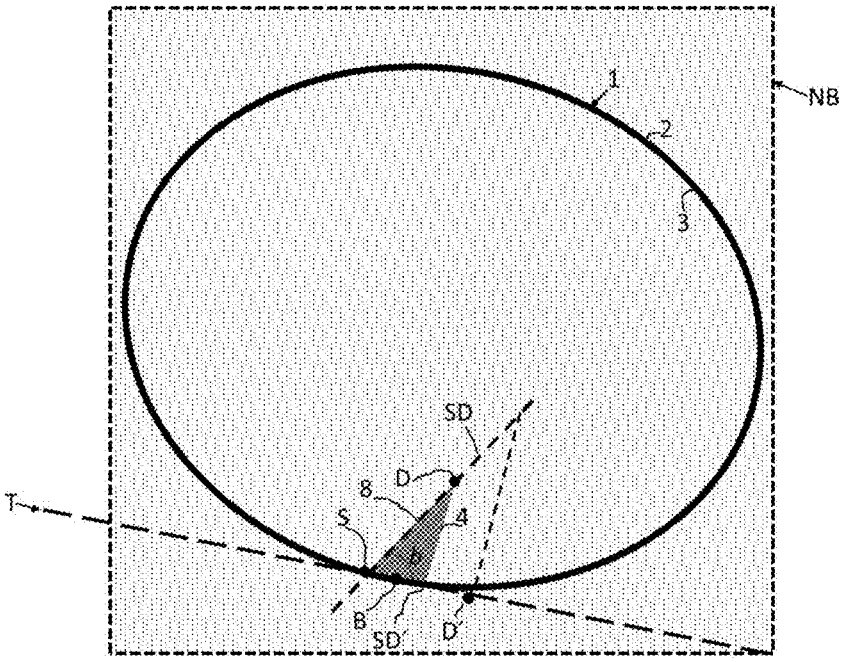
FIG. 5 shows a cross section of another embodiment of the drum of the first and second aspects of the invention, with only one of the drum's paddles indicated therein for the purpose of illustrating how the angle b is defined, and wherein the cross section is normal to the paddle's longitudinal axis.

FIG. 5 shows how the angle b related to the orientation of the paddle's exterior surface 8 of another embodiment of the drum 1 is defined. As shown in FIG. 5, the paddle 4 is attached to the drum's interior surface 3, and the drum's exterior surface 2 is also indicated. The paddle's longitudinal axis LP (not shown) is perpendicular to the indicated plane NB which is parallel to the plane of FIG. 5. Said exterior surface 8 of the paddle 4 has a linear segment defined by two extreme points S, D. Said extreme points S, D are connectable by straight line SD which in between said extreme points S, D does not pass though the external surface 8 of the paddle 4. There is also shown the central point B of the interface between the paddle 4 and the interior surface 3 of the drum 1, and the plane T which is tangent to said interior surface 3 and at said central point B. The tangent plane T is perpendicular to the normal plane NB and for this reason in FIG. 5 the tangent plane T is indicated by a dashed line which is defined by the intersection of the tangent plane T and the normal plane NB. In FIG. 5 there is also indicated the orthogonal projection SD' of line SD on the tangent plane T. The angle b is the angle formed between the straight line SD and its orthogonal projection SD'.

Figure 6:
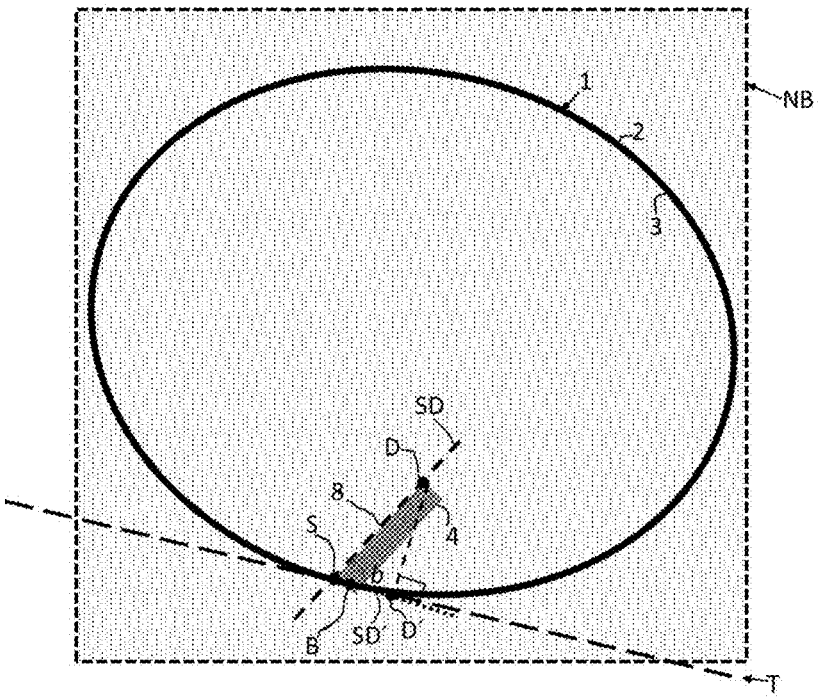
FIG. 6 shows a cross section of another embodiment of the drum of the first and second aspects of the invention, with only one of the drum's paddles indicated therein for the purpose of illustrating how the angle b is defined, and wherein the cross section is normal to the paddle's longitudinal axis.

Similarly to FIG. 5, FIG. 6 also shows how angle b is defined, and the main difference between the two figures is that in FIG. 6 the shape of the shown cross section of the paddle is orthogonal, while in FIG. 5 the corresponding shape is triangular.

Figure 7:
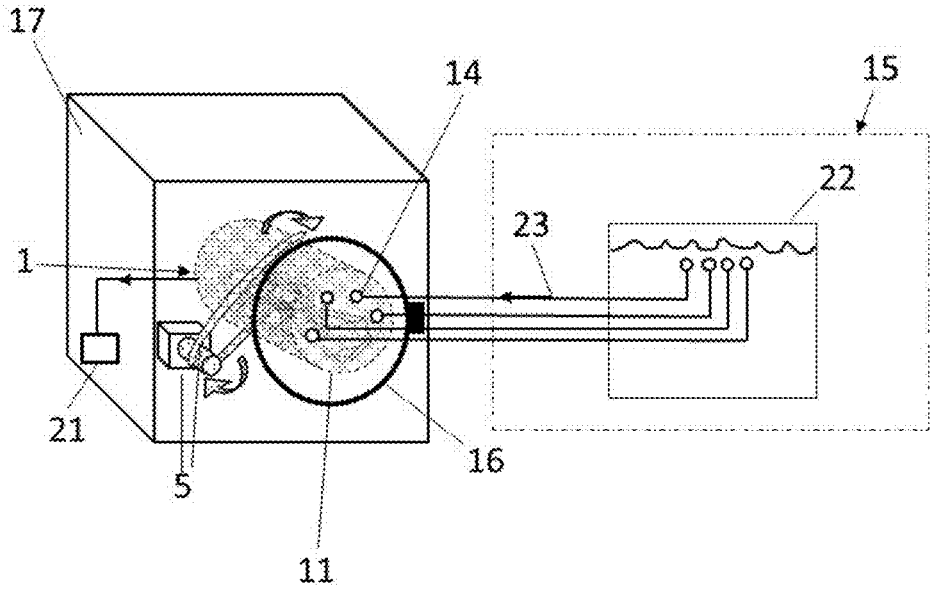
FIG. 7 illustrates some of the elements of an embodiment of the apparatus of the second aspect of the invention.

FIG. 7 shows an embodiment of the apparatus according to the second aspect of the present invention. In this embodiment the apparatus comprises a rotatable drum 1 adapted for being rotated about its longitudinal axis. The drum comprises paddles as described further above, but for clarity of presentation said paddles are not shown in FIG. 7. In this specific embodiment, the drum 1 is enclosed within a chamber 17 which also has movable door 16 with spraying means 14 attached to it. When the door 16 is closed said spraying means 14 face the interior of the drum and the cloths that are potentially there. For clarity of the presentation FIG. 7 shows some cloths positioned/inserted within the drum 1. FIG. 7 also shows the spraying means 14 that are connected to a chemical dispersion supply system 15 and are adapted for spraying to the interior of the drum 1 the chemical dispersion. In this case the dispersion supply system 15 comprises a tank 22 configured to contain the chemical dispersion in a form that can be sprayed by the spraying means, and also comprises tubes 23 connecting said tank 22 to the spaying means 14. Optionally, the tank 22 is also configured to modify the exact properties of the therein contained dispersion, and this can for example be done when the tank comprises a generator of ultrasounds which when is operated results to a better mixing of the dispersion's components and/or the formation of bubbles within the dispersion contained in the tank 22. FIG. 7 also shows that the rotatable drum 1 is connected to rotation means 5 which in this specific case comprise a motor with a rotatable shaft, and an elastic belt connected to both the motor and the drum 1 for rotating the latter. The motor is adapted for rotating the drum in both rotational directions. FIG. 7 also shows that the interior of the drum is connected to a filtering unit 21 configured for filtering out any toxic components of the atmosphere in the interior of the drum 1, when said atmosphere is forced to pass through said filtering unit 21. The presence of the filtering unit 21 is important when the chemical dispersion sprayed into the drum 1 comprises toxic components such as bleaching agents. Nevertheless, it must be emphasized that the filtering unit 21 is an optional element of the apparatus. It must also be mentioned that the filtering unit can optionally be located outside the optional chamber 17 that contains the rotatable drum 1.

Figure 8:
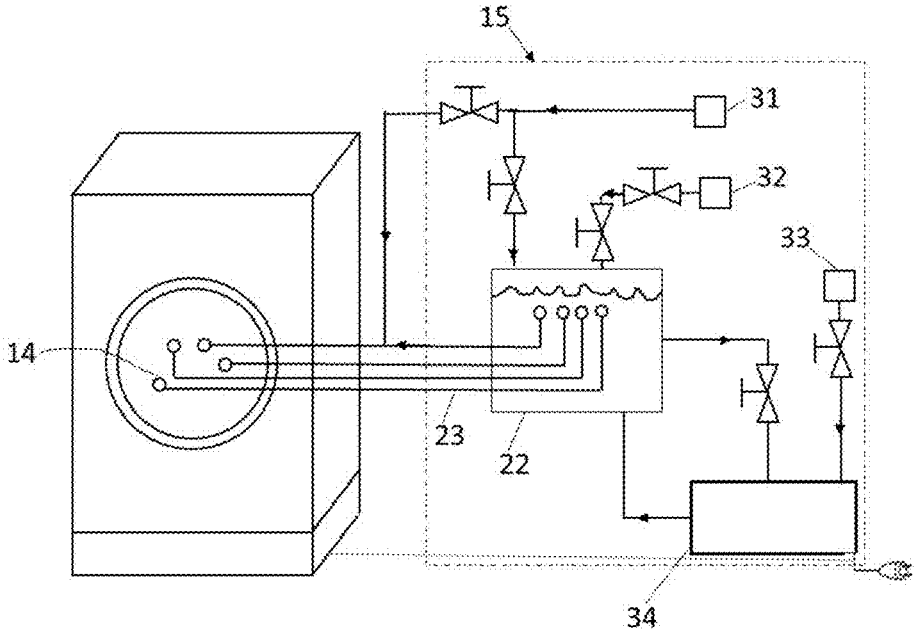
FIG. 8 illustrates some of the elements of another embodiment of the apparatus of the second aspect of the invention.

FIG. 8 shows another and preferred embodiment of the apparatus wherein the chemical dispersion supply system 15 comprises more components compared to the corresponding system of FIG. 7. For clarity of presentation FIG. 8 does not illustrate several of the essential elements of the apparatus such as the drum 1, rather it illustrates in some detail said chemical dispersion supply system 15. The latter as seen in FIG. 8 comprises the tank 22 and the tubes 23 connecting said tank to the spraying means 14. The tank 22 is connected to a liquid supply unit 32 which provides at least one liquid component of the chemical dispersion. The tank 22 is further connected to carrier gas supply unit 31. The carrier gas supply unit 31 is also connected to at least one of the tubes 23 connected to the spraying means 14. The tank 22 is also connected to chemical dispersion preparation means 34 that are configured to mix the content of the tank 22, and optionally mix said content with an additional component provided by an additional component supply unit 33 connected to the chemical dispersion preparation means 34. The additional component supply unit 33 provides a liquid and/or a gas. The chemical dispersion preparation means 34 are further connected to the tank 22 for providing to the latter the chemical dispersion resulting from mixing different components of the dispersion. In one embodiment, the chemical dispersion preparation means is a unit that is configured to mix a gas and a liquid. In another embodiment, the chemical dispersion preparation means 34 are configured to generate a liquid-gas dispersion containing bubbles of the dispersed gas by ultra-sonicating the dispersion.

Figure 10:
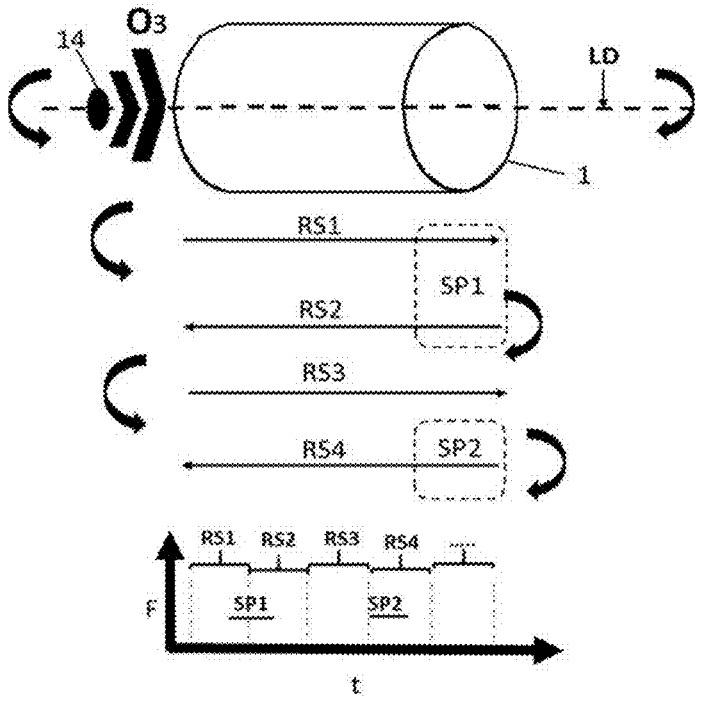
FIG. 10 graphically illustrates the execution of consecutive rotation sessions and spraying sessions as part of the second step of the method.

FIG. 10 shows an example of executing the second step of the method. The drum 1 is rotated about its longitudinal axis LD, and the rotational direction is repeatedly reversed as indicated by the curved arrows. Every two consecutive times the rotational direction changes respectively define the start and the end of a rotation session RS1, RS2, R3, RS4, and the rotation sessions comprise a first subset RS1, RS3, . . . and a second subset RS2, RS4, . . . of rotation sessions, wherein each rotation session of the second subset RS2, RS4, . . . succeeds in time a corresponding session of the first subset RS1, RS3, . . . . The direction towards which the cloths (not shown) inside the drum progressively move during each rotation session is indicated by the long arrows. While rotating, the chemical dispersion is sprayed from the spraying means 14 which in this case are located close to one side of the drum, and in this case the carrier gas is ozone $O_3$ flowing with the chemical dispersion towards the interior of the drum as indicated. Spraying is performed discontinuously in time and in spraying sessions SP1, SP2. As indicated, each spraying session is performed when the cloths are substantially close to the other side of the drum, this is achieved by executing each spraying session when ending a corresponding rotation session of the first subset RS1, RS3, and/or when beginning a corresponding rotation session of the second subset RS2, RS4. The graph at the bottom of FIG. 10 further shows the flow F of spraying as a function of time, thus showing when the spraying sessions SP1, SP2 occur, and the time of executing each of the rotation sessions RS1, RS2, RS3, RS4, . . . is also indicated therein.

According to the above, the first and preferred embodiment of the first aspect of the present invention is a method for treating cloths by spraying with a chemical dispersion comprising a liquid, wherein the method comprises the steps of:

inserting the cloths in the interior of a rotatable drum 1 adapted for being rotated about its longitudinal axis LD, the drum 1 comprising a plurality of paddles 4 which are attached to the interior surface 3 of the drum 1, wherein for each of at least two of said plurality of paddles 4 the paddle's longitudinal axis LP forms an angle a of between 5 degrees and 85 degrees with the geometrical orthogonal projection OP of said paddle's longitudinal axis LP on a geometrical plane N which is normal to the drum's longitudinal axis LD;

rotating the drum 1 about its longitudinal axis LD, and reversing the rotational direction about the drum's longitudinal axis LD at least one time, and during at least part of the duration of rotating spraying the interior of the drum with the chemical dispersion.

The second embodiment of the method is as the first one, wherein the duration of rotating comprises rotation sessions, a rotation session (RS1, RS2, RS3, RS4) being the time between two consecutive events of any of reversing the rotational direction of the drum (1) or beginning or ending rotating, and wherein the set of all rotation sessions comprises a first subset RS1, RS3, . . . and a second subset RS2, RS4, . . . of rotation sessions, wherein each rotation session of the second subset RS2, RS4, . . . succeeds in time a corresponding session of the first subset RS1, RS3, . . . , and wherein in the second step of the method, preventing executing spraying when beginning any of the first subset RS1, RS3, . . . ; and/or, preventing executing spraying when ending any of the second subset RS2, RS4, . . . of the rotation sessions; and/or, executing spraying when ending any of the first subset RS1, RS3, . . . and/or when beginning any of the second subset RS2, RS4, . . . of the rotation sessions; and/or, spraying discontinuously in time by executing consecutive spraying sessions SP1, SP2, . . . , and beginning any or each of the rotation sessions of the second subset RS2, RS4, . . . during executing or when beginning or when ending executing a corresponding one of the spraying sessions SP1, SP2, . . .

The third embodiment of the method is as any of the previous ones, wherein the angle a is of between 50 degrees and 80 degrees.

Another embodiment of the method is as any of the previous ones, wherein in addition an external surface 8 of at least one paddle 4 has a linear segment which has two extreme points S, D that belong to a geometrical plane NB which is normal to the paddles longitudinal axis LP, and are connectable by a straight line SD which in between said extreme points S, D does not pass though the external surface 8 of the paddle 4, and wherein said line SD forms and angle b of between 5 degrees and 85 degrees with the line's orthogonal projection SD' on the geometrical plane T that is tangent to the interior surface 3 of the drum 1 at the center B of the interface between the drum 1 and the paddle 4 belonging to said geometrical plane NB which is normal to the paddle's longitudinal axis LP.

Another embodiment of the method is according to any of the aforementioned ones, wherein in addition the drum 1 has a substantially cylindrical, or ellipsoidal or polygonal or more complex shape. Preferably though, the drum has a substantially cylindrical shape.

Another embodiment of the method is according to any of the aforementioned ones, wherein in addition the chemical dispersion further comprises a gas.

Another embodiment of the method is according to any of the aforementioned ones, wherein in addition the dispersing medium of the chemical dispersion is a liquid and the dispersed substance of the dispersion comprises a gas.

Another embodiment of the method is according to previous one, wherein the dispersed substance forms bubbles the diameter of which is of between 10 nanometers and 900 micrometers. Said bubble sizes are measurable using light scattering optical techniques, and for example can be measured using the commercially available instrument SALD-7500 nano by Shimadzu.

Another embodiment of the method is according to any of the aforementioned ones wherein the dispersion comprises a gas which includes any of air, nitrogen, oxygen, ozone, argon, carbon dioxide, hydrogen.

Another embodiment of the method is according to any of the aforementioned ones, wherein spraying is done using a carrier gas that comprises any of air, nitrogen, oxygen, ozone, argon, carbon dioxide, hydrogen.

Another embodiment of the method is according to any of the previous ones wherein the chemical dispersion is an aerosol comprising liquids and solids.

Another embodiment of the method is according to any of the previous ones wherein the chemical dispersion includes any of: a chemical product commonly used for cloth finishing, a fabric softener, a conditioner, a detergent, an enzyme, a dye, an acid, a base, a silicone, a fatty acid, a reticulation resin, a polymerizing resin, a bleach, an odorizing additive similar to a perfume, an antimicrobial agent, a bactericide, a fluorocarbon, an antivectorial product, a pigment, a nanomaterial, a hydrophilic substance, a hydrophobic substance.

In another embodiment of the method as described above, the second step of the method is implemented in the following mode:

rotating the drum about one rotational directional about the drum's longitudinal axis;

spraying to the interior of the drum the chemical dispersion;

reversing the rotational direction at which the drum is being rotated about the drum's longitudinal axis.

In another embodiment of the method as described above, the second step of the method is implemented in the following mode:

rotating the drum about one rotational directional about the drum's longitudinal axis;

reversing the rotational direction at which the drum is being rotated about the drum's longitudinal axis;

spraying to the interior of the drum the chemical dispersion.

Another embodiment of the method is according to any of the previous two ones, wherein as part of the second step of the method further performing any or both of the following steps, in any order between them:

reversing the rotational direction at which the drum is being rotated about the drum's longitudinal axis;

spraying to the interior of the drum the chemical dispersion.

In another embodiment, spraying is continuous while rotating the drum.

Another embodiment of the present invention is according to any of the previous ones wherein the chemical dispersion is at a pressure of at least 2 bars, and preferably the pressure is of between 2 bars and 60 bars, and more preferably between 2 bars and 30 bars, and most preferably between 6 bars and 30 bars. Said pressure values are measurable, this is to say can be measured, by optionally installing a pressure gauge installed in the chemical dispersion system 15 and for example on one of the tubes 23.

Another embodiment of the present invention is according to any of the previous ones wherein further comprises stopping the second step of the method when a wet pick up value of between 5% and 150%, and preferably of between 40% and 120%, and optionally of between 5% and 50%.

Another embodiment of the present invention is according to any of the previous ones wherein the second step of the method preferably lasts between 1 minutes and 120 minutes, more preferably between 1 minute and 60 minutes, and most preferably between 2 minutes and 30 minutes.

Another embodiment of the present invention is according to any of the previous ones wherein the chemical dispersion is being sprayed through an at least one area which is substantially close to a mouth of the drum.

Another embodiment of the present invention is according to any of the previous ones wherein the maximum duration of each rotation session is 300 seconds, and preferably is 120 seconds, and more preferably is 60 seconds, and preferably is 5 seconds.

Also according to the above, a preferred embodiment of the second aspect of the present invention is an apparatus arranged for treating cloths with a chemical dispersion comprising a liquid, the apparatus comprising:

a rotatable drum 1 adapted for being rotated about its longitudinal axis, that comprises a plurality of paddles 4 which are attached to the interior surface 3 of the drum 1, wherein for each of at least two of said plurality of paddles 4 the paddle's longitudinal axis LP forms an angle a of between 5 degrees and 85 degrees with the geometrical orthogonal projection OP of said paddle's longitudinal axis LP on a geometrical plane N which is normal to the drum's longitudinal axis LD;

rotation means 5 connected to the drum 1 and adapted for rotating it in each direction about its longitudinal axis LP;

spraying means 14 adapted for spraying to the interior of the drum 1 the chemical dispersion;

a dispersion supply system 15 connected to the spraying means 14 and adapted for providing to the latter the chemical dispersion.

Another embodiment of the apparatus is according to the previous embodiment, wherein the spraying means 14 are positioned substantially close to a mouth 11 of the drum 1.

Another embodiment of the apparatus is according to any of the previous ones, wherein the apparatus further comprises a chamber 17 that encloses said rotatable drum 1 and comprises a movable door 16 which when closed faces a mouth 11 and the interior of the drum 1, and wherein the spraying means 14 are attached to said movable door 16.

Another embodiment of the apparatus is according to any of the previous ones, wherein an external surface 8 of at least one paddle 4 has a linear segment which has two extreme points S, D that belong to a geometrical plane NB which is normal to the paddle's longitudinal axis LP, and are connectable by a straight line SD which in between said extreme points S, D does not pass though the external surface 8 of the paddle 4, and wherein said line SD forms and angle b of between 5 degrees and 85 degrees with the line's orthogonal projection SD' on the geometrical plane T that is tangent to the interior surface 3 of the drum 1 at the center B of the interface between the drum 1 and the paddle 4 belonging to said geometrical plane NB which is normal to the paddle's longitudinal axis LP.

Another embodiment of the apparatus is according to any of the previous ones, wherein the apparatus further comprises a filtering unit 21 connected to the interior of the rotatable drum 1 and configured for filtering out any toxic components of the atmosphere of the interior of the drum 1.

Another embodiment of the apparatus is according to any of the previous ones, wherein the dispersion supply system 15 comprises a tank 22 configured to at least contain the liquid of the chemical dispersion, and tubes 23 connected to said tank 22 and the spraying means 14, and optionally comprises any of the following and combinations thereof:

a supply unit 32 connected to the tank 22 and configured for providing to the latter at least one liquid component of the chemical dispersion.

a carrier gas supply unit 31 connected to the tank 22 and optionally connected to at least one of the tubes 23, and configured to supply a carrier gas.

chemical dispersion preparation means 34 connected to the tank 22 and configured to mix the content of the tank 22, and optionally mix said content with an additional gas and/or component provided by an additional component supply unit 33 connected to said chemical dispersion preparation means 34.

Another embodiment of the apparatus is according to any of the previous ones, wherein the apparatus comprises a computer connected to and adapted to controlling the rotation means and the injection means, and is further adapted to execute the second step of the method.

Figure 9:
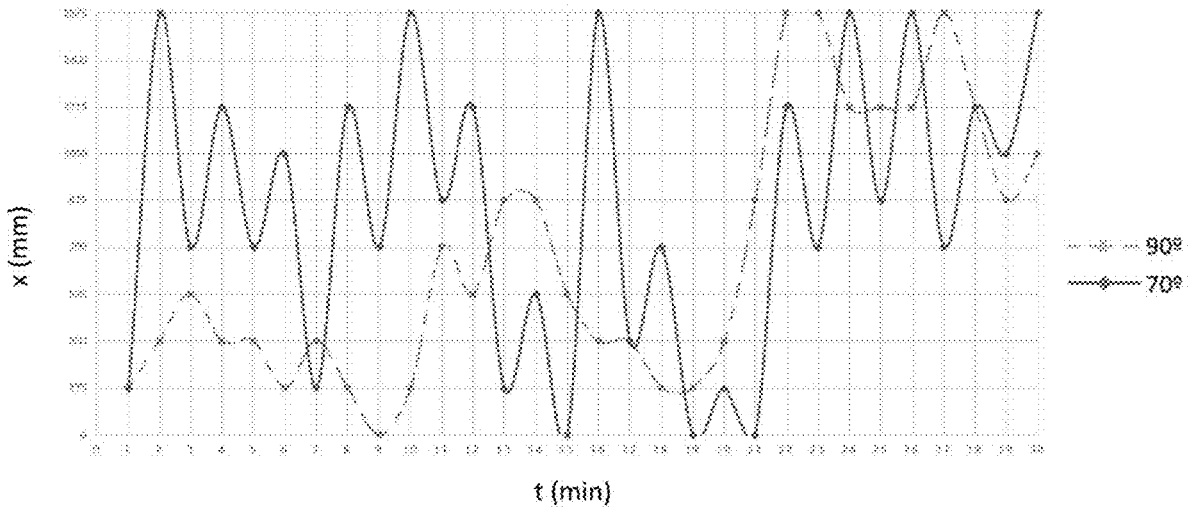
FIG. 9 shows the position of a cloth inside a drum related to the invention, versus the time of rotating the drum.

The herein described invention has been realized and implemented by the inventors as follows:

A drum according to the invention was manufactured and fitted to a commercial machine (model CB320, Jeanologia). Said machine was further adapted, for example fitted with a filtering unit and adapted so that the pressure of the chemical dispersion is more than 6 bars, and the machine's computer was also programmed for executing the method of the invention. The drum had a length of approximately 1.57 m and three paddles disposed in symmetric positions around the interior surface of the drum, each paddle extending lengthwise from one mouth of the drum to the other and being disposed at an angle a=70°. 100 kg of cloths were inserted in the drum and then the latter was rotated at about 27 rounds per minute for 30 minutes while the rotational direction was reversed every 2 minutes, and while from the front mouth of the drum the cloths were sprayed with a chemical dispersion comprising water and a bleaching agent. The position x along the length of the drum of a specific cloth of red color which was easy to distinguish from all other cloths because the latter were blue, was visually inspected and recorded every 1 minute. The recorded data showed that said red cloth was reciprocating along the length of the drum, and said data are shown in FIG. 9 which contains the plot of position x (m) versus time t (min). It is noted that x=0 m corresponds to the front mouth of the drum and x=1.57 m corresponds to the back mouth of the drum.

The experiment was repeated with the following modification: a=90°. The obtained data are also shown in the corresponding plot of FIG. 9. As is obvious from FIG. 9, an angle a=70° results to the red cloth reciprocating across greater lengths along the drum and at a higher and nearly consistent frequency of 1 min, compared to what happened for an angle a=90°. Consequently, when a=70° the treatment of the cloths was better and more homogeneous compared to the treatment when a=90°. This demonstrates how critical angle a is for the method and the apparatus of the present invention. By applying the present invention, it has been found that the processed cloths are treated homogeneously and present more than 50% less processing-induced defects, and also it has been found that less liquid and overall chemical dispersion is needed for treating the cloths homogeneously.

While the foregoing is directed to embodiments of the present invention, other and further embodiments of the invention may be devised without departing from the basic scope thereof.

The scope of the present invention is defined in the following set of claims.

The invention claimed is:

1. A method for treating cloths comprising:

inserting the cloths in an interior of a rotatable drum configured to be rotated about a longitudinal axis of the rotatable drum, the rotatable drum comprising a plurality of paddles which are attached to an interior surface of the rotatable drum, wherein a longitudinal axis of each paddle of the plurality of paddles forms an angle a of between 5 degrees and 85 degrees with geometrical orthogonal projection of the longitudinal axis of the respective paddle on a geometrical plane which is normal to the longitudinal axis of the rotatable drum;

spraying, with a dispersion supply system, a chemical dispersion comprising a liquid;

rotating the rotatable drum about the longitudinal axis of the rotatable drum, wherein a rotational direction about the longitudinal axis of the rotatable drum is reversed at least one time during at least part of a duration of the rotation of the rotatable drum, with the dispersion supply system spraying the interior of the rotatable drum with the chemical dispersion, wherein the dispersion supply system is located in front of a mouth of the rotatable drum and facing an opening towards the interior of the rotatable drum, located on a ring-shaped perimeter of the mouth of the rotatable drum, or attached to a movable door of a chamber that encloses said rotatable drum, and said movable door when closed faces the mouth and the interior of the rotatable drum.

2. The method according to claim 1, wherein the duration of rotation of the rotatable drum comprises a plurality of rotation sessions, each rotation session being a time between two consecutive reversals of the rotational direction of the rotatable drum a set of all rotation sessions of the plurality of rotation sessions comprises a first subset of rotation sessions and a second subset of rotation sessions, wherein each rotation session of the second subset of rotation sessions succeeds in time a corresponding session of the first subset of rotation sessions, and spraying occurs when either ending any of the first subset of rotation sessions or beginning any of the second subset of rotation sessions.

3. The method according to claim 1, wherein an external surface of at least one paddle of the plurality of paddles has a linear segment which has two extreme points that belong to a geometrical plane which is normal to the longitudinal axis of the at least one paddle, and the two extreme points are connectable by a straight line which does not pass through an external surface of the at least one paddle, and an angle b of between 5 degrees and 85 degrees is formed between the linear segment and an orthogonal projection of the linear segment on a geometrical plane that is tangent to the interior surface of the rotatable drum at a center of an interface between the rotatable drum and the at least one paddle belonging to said geometrical plane which is normal to the longitudinal axis of the at least one paddle.

4. The method according to claim 1, wherein the angle a is between 50 degrees and 80 degrees.

5. The method according to claim 1, wherein the chemical dispersion further comprises a gas.

6. The method according to claim 5, wherein the gas is any of air, nitrogen, oxygen, ozone, argon, carbon dioxide, hydrogen, and combinations thereof.

7. The method according to claim 5, wherein a dispersing medium of the chemical dispersion is the liquid and a dispersed substance of the chemical dispersion comprises the gas.

8. The method according to claim 1, wherein the chemical dispersion is at a pressure of between 2 bars and 60 bars.

9. The method according to claim 1, wherein the chemical dispersion comprises any of a fabric softener, a conditioner, a detergent, an enzyme, a dye, an acid, a base, a silicone, a fatty acid, a reticulation resin, a polymerizing resin, a bleach, an odorizing additive similar to a perfume, an antimicrobial agent, a bactericide, a fluorocarbon, an antivectorial product, a pigment, a nanomaterial, a hydrophilic substance, and a hydrophobic substance.

10. The method according to claim 1, wherein the chemical dispersion is sprayed through at least one area which is substantially close to a mouth of the rotatable drum.

11. An apparatus configured to treat cloths with a chemical dispersion comprising a liquid, the apparatus comprising:

a rotatable drum configured to be rotated about a longitudinal axis of the rotatable drum, comprising a plurality of paddles which are attached to an interior surface of the rotatable drum, wherein a longitudinal axis of each paddle forms an angle a of between 5 degrees and 85 degrees with geometrical orthogonal projection of a longitudinal axis of the respective paddle on a geometrical plane which is normal to the longitudinal axis of the rotatable drum;

a motor connected to the rotatable drum and configured to rotate the rotatable drum in each direction about the longitudinal axis of the rotatable drum;

a nozzle configured to spray the chemical dispersion to an interior of the rotatable drum;

a dispersion supply system connected to the nozzle and configured to provide the chemical dispersion to the nozzle, wherein the nozzle is located in front of a mouth of the rotatable drum and faces an opening towards the interior of the rotatable drum, located on a ring-shaped perimeter of the mouth of the rotatable drum, or a chamber configured to enclose said rotatable drum comprises a movable door which, when closed, faces a mouth and the interior of the rotatable drum and the nozzle is attached to said movable door.

12. The apparatus according to claim 11, wherein the nozzle is positioned substantially close to the mouth of the rotatable drum.

13. The apparatus according to claim 11, wherein an external surface of at least one paddle has a linear segment which has two extreme points that belong to a geometrical plane which is normal to a longitudinal axis of the at least one paddle, the two extreme points are connectable by a straight line which does not pass through an external surface of the at least one paddle, and an angle b of between 5 degrees and 85 degrees is formed between the linear segment and an orthogonal projection of the linear segment on a geometrical plane that is tangent to the interior surface of the rotatable drum at a center of an interface between the rotatable drum and the at least one paddle belonging to said geometrical plane which is normal to the longitudinal axis of the at least one paddle.

14. The apparatus according to claim 11, further comprising:

a computer connected to and configured to control the motor.

15. The apparatus according to claim 11, further comprising:

a filtering unit connected to the interior of the rotatable drum and configured to filter out any toxic components of an atmosphere of the interior of the rotatable drum.

16. The apparatus according to claim 11, wherein the dispersion supply system further comprises:

a tank configured to at least contain the liquid of the chemical dispersion, and tubes connected to said tank and the nozzle.

17. The apparatus according to claim 16, further comprising:

a carrier gas supply connected to the tank and configured to supply a carrier gas.

* * * * *